US009032554B2

(12) United States Patent
Lucier

(10) Patent No.: US 9,032,554 B2
(45) Date of Patent: May 19, 2015

(54) MASK

(71) Applicant: Cary M Lucier, Windsor (CA)

(72) Inventor: Cary M Lucier, Windsor (CA)

( * ) Notice: Subject to any disclaimer, the term of this patent is extended or adjusted under 35 U.S.C. 154(b) by 0 days.

(21) Appl. No.: 13/688,201

(22) Filed: Nov. 28, 2012

(65) Prior Publication Data

US 2014/0150164 A1 Jun. 5, 2014

(30) Foreign Application Priority Data

Mar. 29, 2012 (CA) ..... 2772864

(51) Int. Cl.
*A41G 7/00* (2006.01)
*A63H 33/16* (2006.01)

(52) U.S. Cl.
CPC . *A41G 7/00* (2013.01); *Y10S 273/17* (2013.01)

(58) Field of Classification Search
CPC ..... A41G 7/00; A41G 7/02; A41D 13/11; A41D 2400/42; A41D 2400/52; A42B 1/208; A42B 1/004; A45D 44/002; A45D 44/12; A63H 33/16; B44C 5/00
See application file for complete search history.

(56) References Cited

U.S. PATENT DOCUMENTS 727,173 A * 5/1903 Merrell ..... 2/206
2,000,242 A * 5/1935 Manning ..... 2/173
2,011,800 A * 8/1935 De Dubois ..... 2/206
2,021,593 A * 11/1935 Einson ..... 2/206
2,043,209 A * 6/1936 Eisner et al. ..... 40/539
2,127,054 A * 8/1938 Cesar ..... 2/206
2,127,620 A * 8/1938 Sabaneeff ..... 2/206
2,258,531 A * 10/1941 Baldwin ..... 446/7
2,262,992 A * 11/1941 Dessart ..... 2/206
2,262,993 A * 11/1941 Dessart ..... 2/206
2,441,333 A * 5/1948 Reinsberg ..... 40/539
2,507,447 A * 5/1950 La Joie et al. ..... 2/174
2,513,019 A * 6/1950 Grady ..... 2/206
2,558,263 A * 6/1951 Merrill ..... 604/303
2,565,124 A * 8/1951 Durborow ..... 128/206.19
2,637,038 A * 5/1953 Bower ..... 2/206
2,677,133 A * 5/1954 Hoffman, Jr. ..... 2/206
2,711,541 A * 6/1955 Bellett ..... 2/206
2,716,981 A * 9/1955 More ..... 604/303
2,722,688 A * 11/1955 Wojnar ..... 2/205
2,795,796 A * 6/1957 Ray ..... 2/206
2,832,961 A * 5/1958 Weiss ..... 2/200.3
2,856,608 A * 10/1958 Wagenfeld ..... 2/195.7
2,914,772 A * 12/1959 Lemelson ..... 2/206
3,009,163 A * 11/1961 Beauvais ..... 2/206
3,089,148 A * 5/1963 Grossberg ..... 2/206
3,129,001 A * 4/1964 Winchell ..... 2/206
3,134,984 A * 6/1964 Ward ..... 2/206
3,221,345 A * 12/1965 Berg ..... 2/195.7
3,295,511 A * 1/1967 Crouzet ..... 126/208
3,599,240 A * 8/1971 Shapur ..... 2/75
3,917,153 A * 11/1975 Holschneider ..... 229/116.1
4,027,340 A * 6/1977 Hadtke ..... 2/206
4,121,304 A * 10/1978 Cooper ..... 2/206
4,175,411 A * 11/1979 Allen et al. ..... 2/173
4,453,629 A * 6/1984 Goldberg ..... 206/457

(Continued)

*Primary Examiner* — Bobby Muromoto, Jr.
(74) *Attorney, Agent, or Firm* — Mervyn J. Valadares

(57) ABSTRACT

A mask is assembled from a single blank. The blank is creased and folded to make a front, top and a back panel, with the top panel folding down to make two side panels. The side panels cooperate with the front and back panels by connections protruding from the panels. The mask can be stored or shipped in a flat two-dimensional, unassembled mode and can be opened or assembled to a three-dimensional form, which may be worn on the head of a user.

15 Claims, 12 Drawing Sheets

(56) References Cited

U.S. PATENT DOCUMENTS

| | | | | | |
|---|---|---|---|---|---|
| 4,520,509 | A * | 6/1985 | Ward | 2/206 |
| 4,674,133 | A * | 6/1987 | Oschner | 2/206 |
| 4,969,213 | A * | 11/1990 | Gruneisen, III | 2/12 |
| 5,010,590 | A * | 4/1991 | Haber et al. | 2/12 |
| 5,072,460 | A * | 12/1991 | Weder | 2/206 |
| 5,123,870 | A * | 6/1992 | Cahill | 446/372 |
| 5,129,103 | A * | 7/1992 | Gruneisen | 2/12 |
| 5,157,852 | A * | 10/1992 | Patrou et al. | 40/800 |
| 5,214,800 | A * | 6/1993 | Braun | 2/173 |
| 5,465,427 | A * | 11/1995 | Shields | 2/206 |
| 5,623,802 | A * | 4/1997 | Boushek et al. | 52/543 |
| 5,634,210 | A * | 6/1997 | King et al. | 2/9 |
| 5,727,499 | A * | 3/1998 | Armington et al. | 119/168 |
| 5,730,085 | A * | 3/1998 | Santoiemmo | 119/168 |
| 6,941,582 | B2 * | 9/2005 | Miska | 2/200.3 |
| 6,997,771 | B1 * | 2/2006 | Lucier | 446/108 |
| 8,165,698 | B2 * | 4/2012 | Lehtoluoto | 607/140 |
| 8,387,163 | B2 * | 3/2013 | Beliveau | 2/9 |
| 8,567,021 | B2 * | 10/2013 | McCabe | 24/586.11 |
| 2002/0020002 | A1 * | 2/2002 | Yeh | 2/206 |
| 2002/0088043 | A1 * | 7/2002 | Cook | 2/9 |
| 2002/0104543 | A1 * | 8/2002 | Hollander et al. | 128/205.29 |
| 2003/0014800 | A1 * | 1/2003 | Meyers | 2/15 |
| 2003/0028946 | A1 * | 2/2003 | Zegarelli et al. | 2/9 |
| 2004/0111779 | A1 * | 6/2004 | Gagnon et al. | 2/9 |
| 2006/0048278 | A1 * | 3/2006 | Pitsolis | 2/206 |
| 2006/0070160 | A1 * | 4/2006 | Reitz | 2/9 |
| 2006/0143798 | A1 * | 7/2006 | Chen | 2/206 |
| 2007/0062843 | A1 * | 3/2007 | Rudd | 206/581 |
| 2007/0293118 | A1 * | 12/2007 | Prescott | 446/148 |
| 2008/0229481 | A1 * | 9/2008 | Yeh et al. | 2/206 |
| 2008/0318751 | A1 * | 12/2008 | Lee | 493/340 |
| 2009/0061728 | A1 * | 3/2009 | Gardi | 446/27 |
| 2009/0241242 | A1 * | 10/2009 | Beatty et al. | 2/206 |
| 2009/0276937 | A1 * | 11/2009 | Zheng et al. | 2/79 |
| 2009/0318052 | A1 * | 12/2009 | Prescott | 446/148 |
| 2010/0212065 | A1 * | 8/2010 | Yeh | 2/206 |
| 2010/0228204 | A1 * | 9/2010 | Beatty et al. | 604/303 |
| 2010/0241056 | A1 * | 9/2010 | Lehtoluoto | 604/20 |
| 2011/0152795 | A1 * | 6/2011 | Aledo et al. | 604/290 |
| 2011/0239347 | A1 * | 10/2011 | Beliveau | 2/9 |
| 2012/0071060 | A1 * | 3/2012 | Cannon | 446/73 |
| 2012/0073030 | A1 * | 3/2012 | Beatty et al. | 2/206 |
| 2013/0047315 | A1 * | 2/2013 | Yeh | 2/206 |
| 2013/0055486 | A1 * | 3/2013 | Hasbany et al. | 2/206 |

* cited by examiner

MASK

FIELD OF THE INVENTION

The invention herein pertains to a blank which is assembled to make a three-dimensional wearable face mask.

BACKGROUND OF THE INVENTION

This invention relates to improvements in flexible masks and, more particularly, to flexible masks that may be stored flat and can be opened up to three-dimensional forms to cover the face, top and back of a user's head to simulate known or fictional characters.

Prior art blanks which are assembled to make three-dimensional masks or head coverings are illustrated and described in U.S. Pat. Nos. 5,214,800 and 6,941,582.

Such blanks form sport helmet-type shapes or other mask shapes which are not appropriate for imprinting a humanoid face.

There is a need for a simple mask, assembled from a single blank, which can be stored easily in a flat mode, and which is adapted for printing a humanoid face, such as a known person or fictional character.

BRIEF DESCRIPTION OF THE DRAWINGS

The invention together with further objects and advantages thereof may be best understood by reference to the following detailed description taken in conjunction with the accompanying sheets of drawings in the several figures of which like reference numerals identify like elements, and in which.

DETAILED DESCRIPTION

Figure 1:
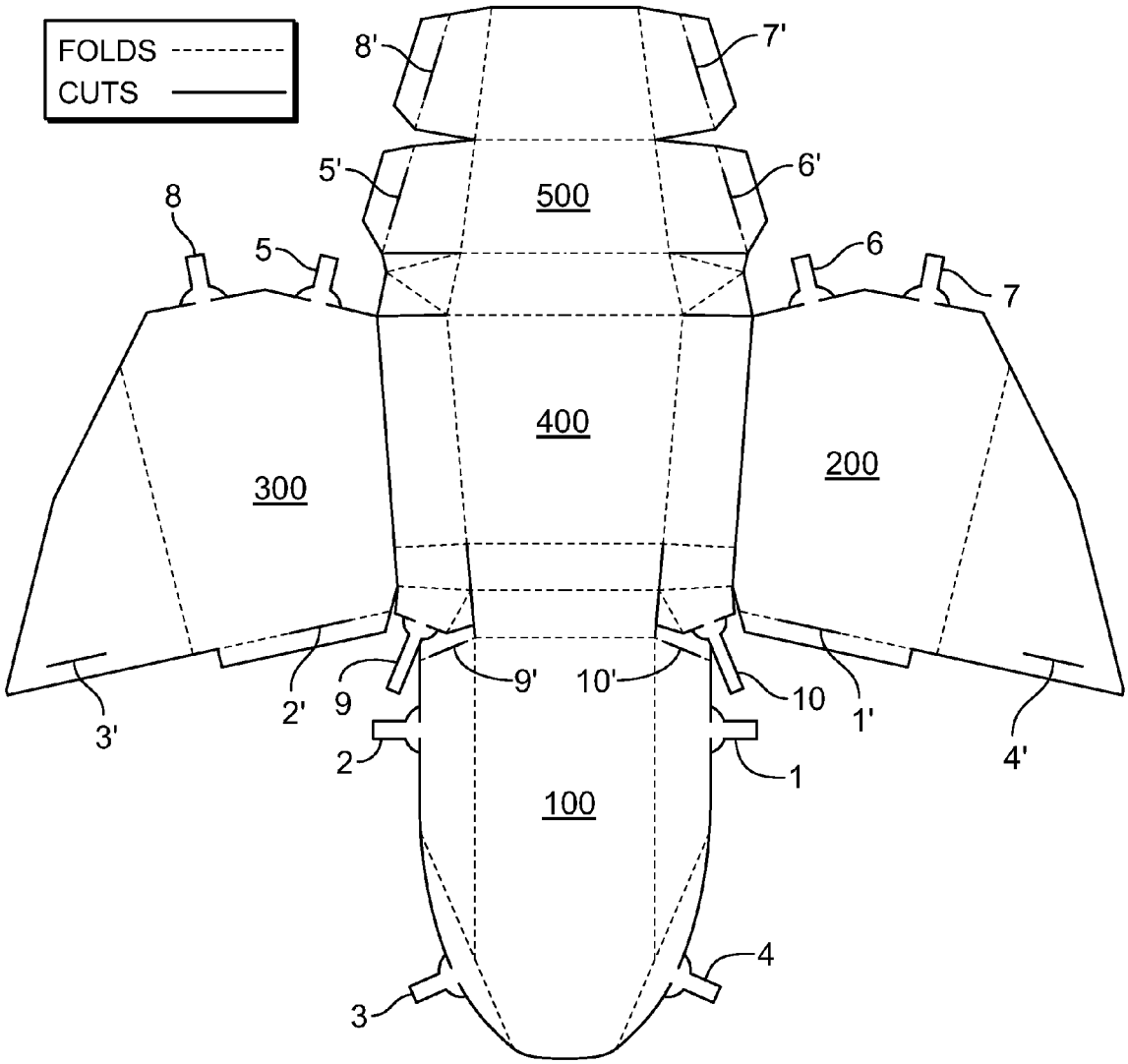
FIG. 1 is a top plan view of a blank mask of the present invention showing a first embodiment.

The blank of the present invention is made from a single piece which comprises folds and connections. The connections protrude from a plurality of panels.

FIGS. 1-7 depict embodiments of the two-dimensional blank mask of the present invention. FIGS. 1-6 are blanks without any design. The blanks show a plurality of folds in dotted line. The overall shape of the blanks is of a butterfly, wherein the head is the front panel 100, the wings are the right side panel 200 (ie: the butterfly's left wing) and left side panel 300 (ie: the butterfly's right wing), the torso is the top panel 400 and the tail is the back panel 500. The five panels are joined by connections formed in the blank.

Figure 2:
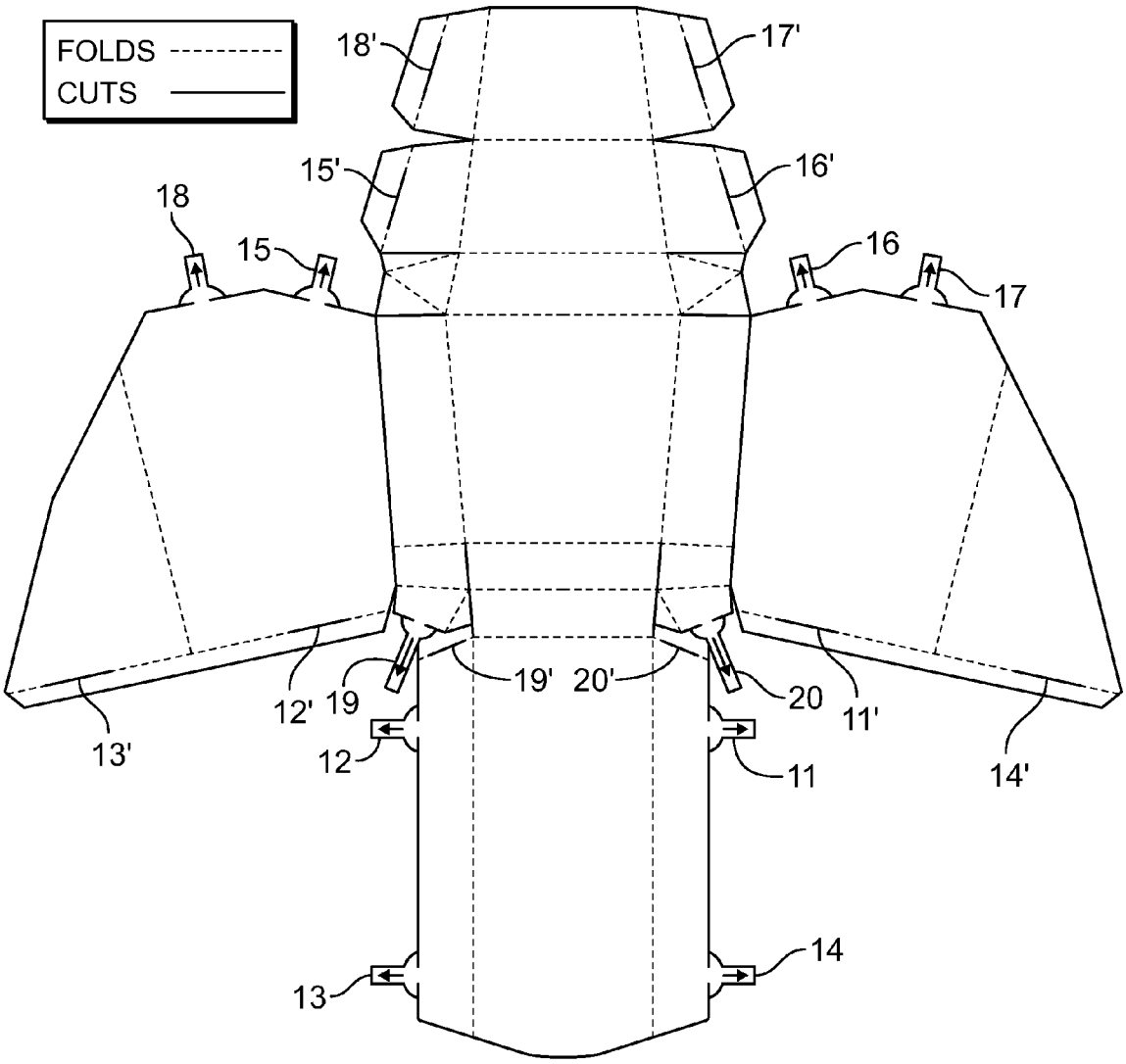
FIG. 2 is a top plan view of a blank mask of the present invention showing a second embodiment.
Figure 3:
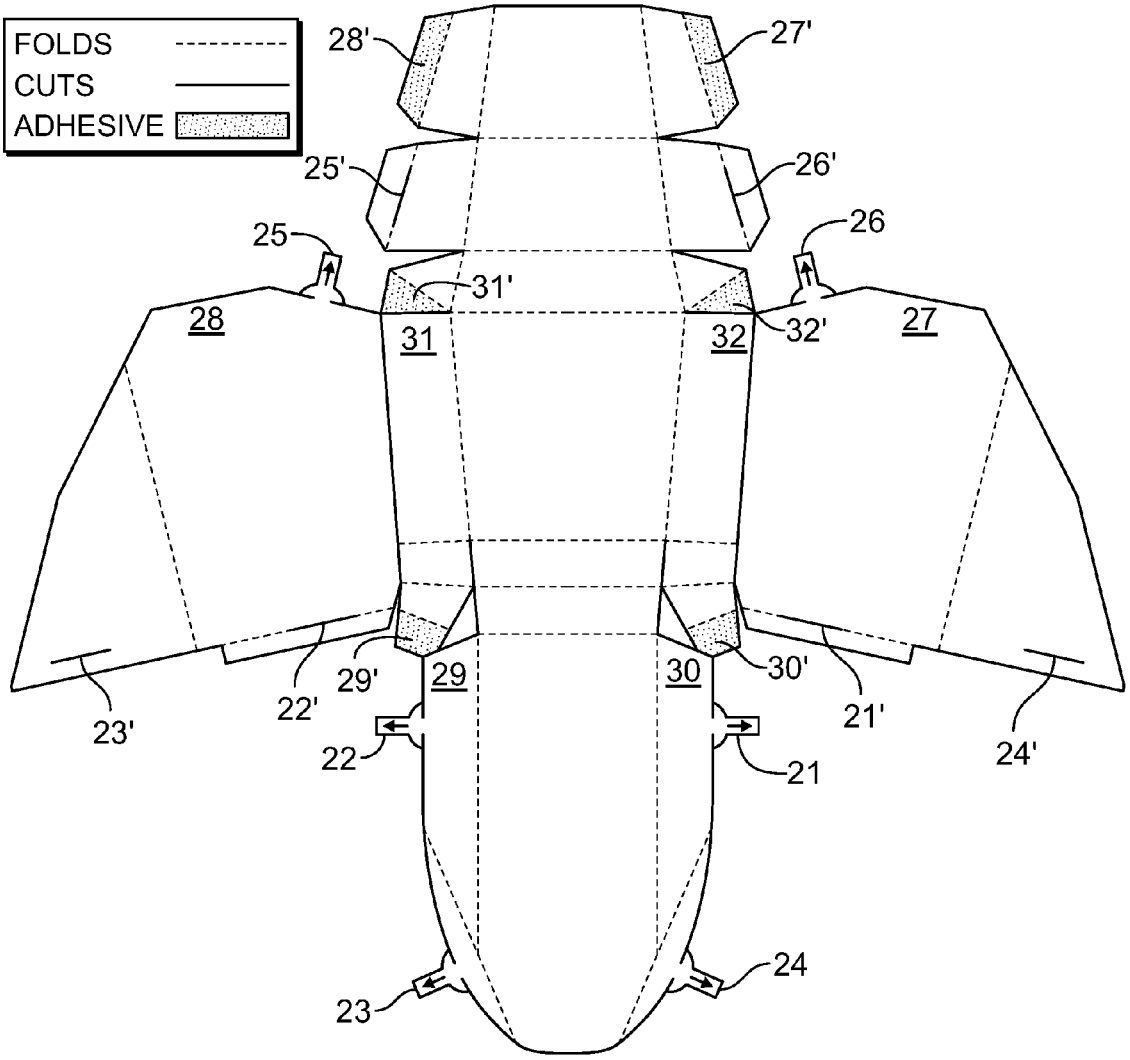
FIG. 3 is a top plan view of a blank mask of the present invention showing a third embodiment.
Figure 4:
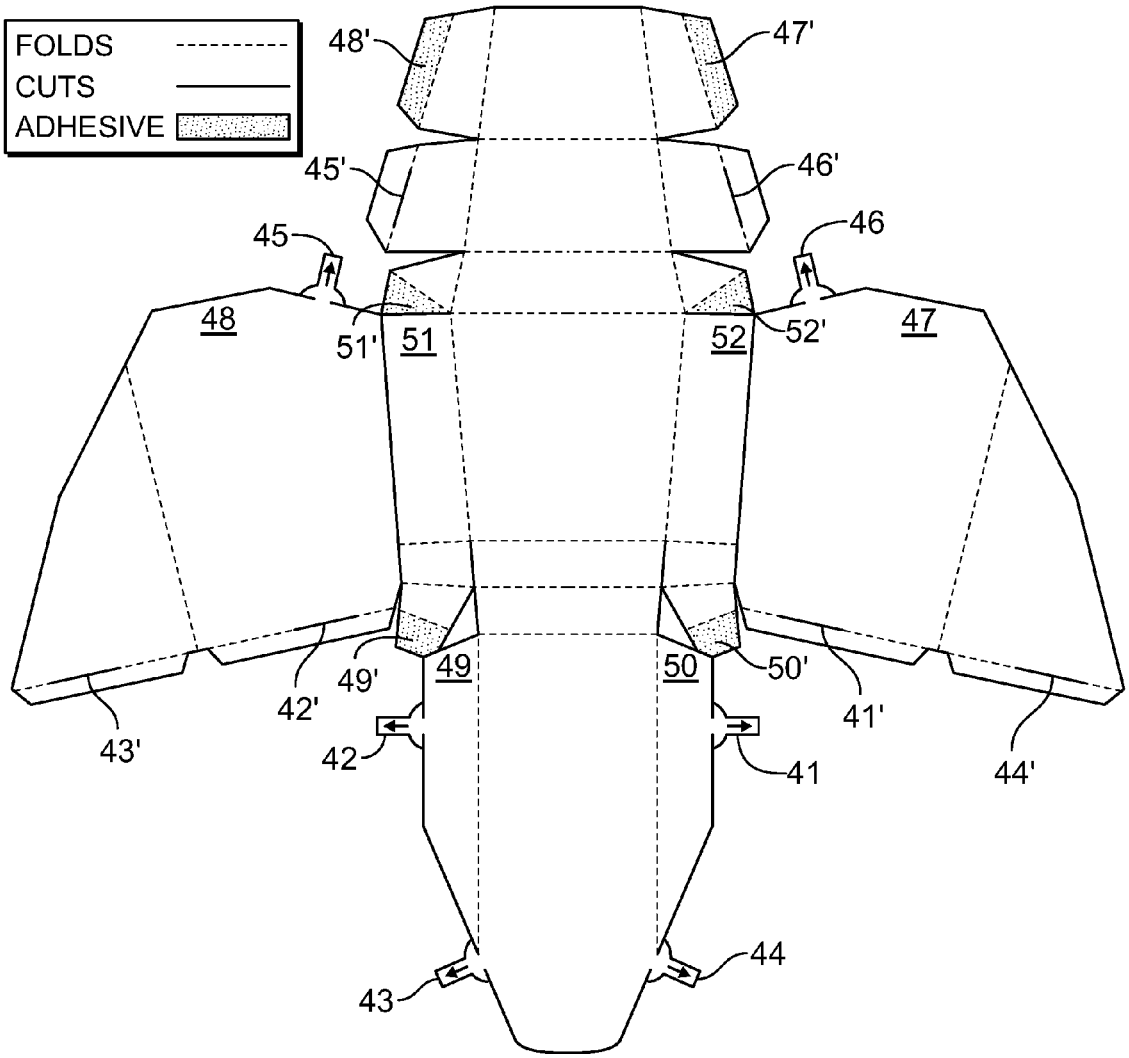
FIG. 4 is a top plan view of a blank mask of the present invention showing a fourth embodiment.
Figure 5:
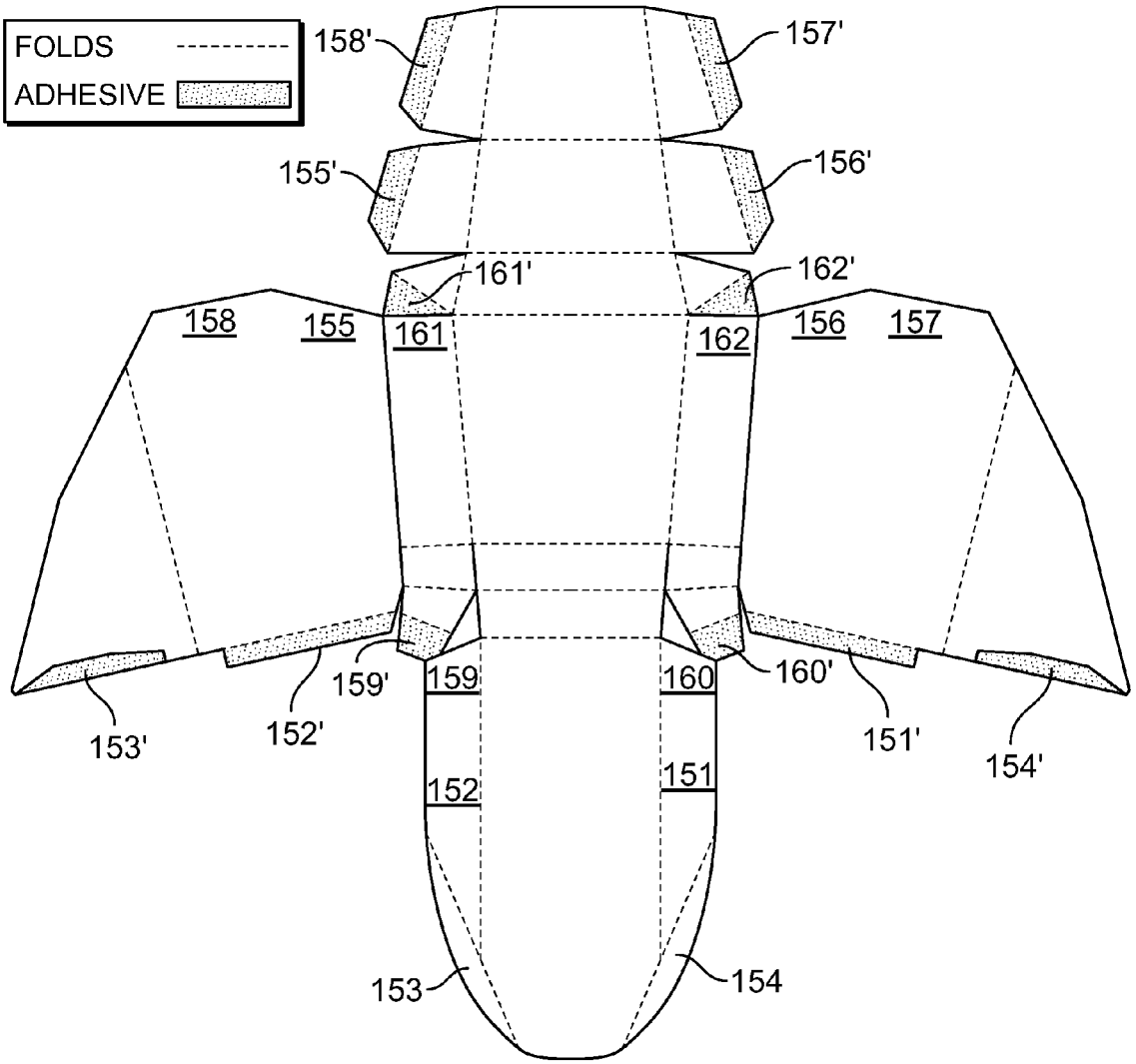
FIG. 5 is a top plan view of a blank mask of the present invention showing a fifth embodiment.
Figure 6:
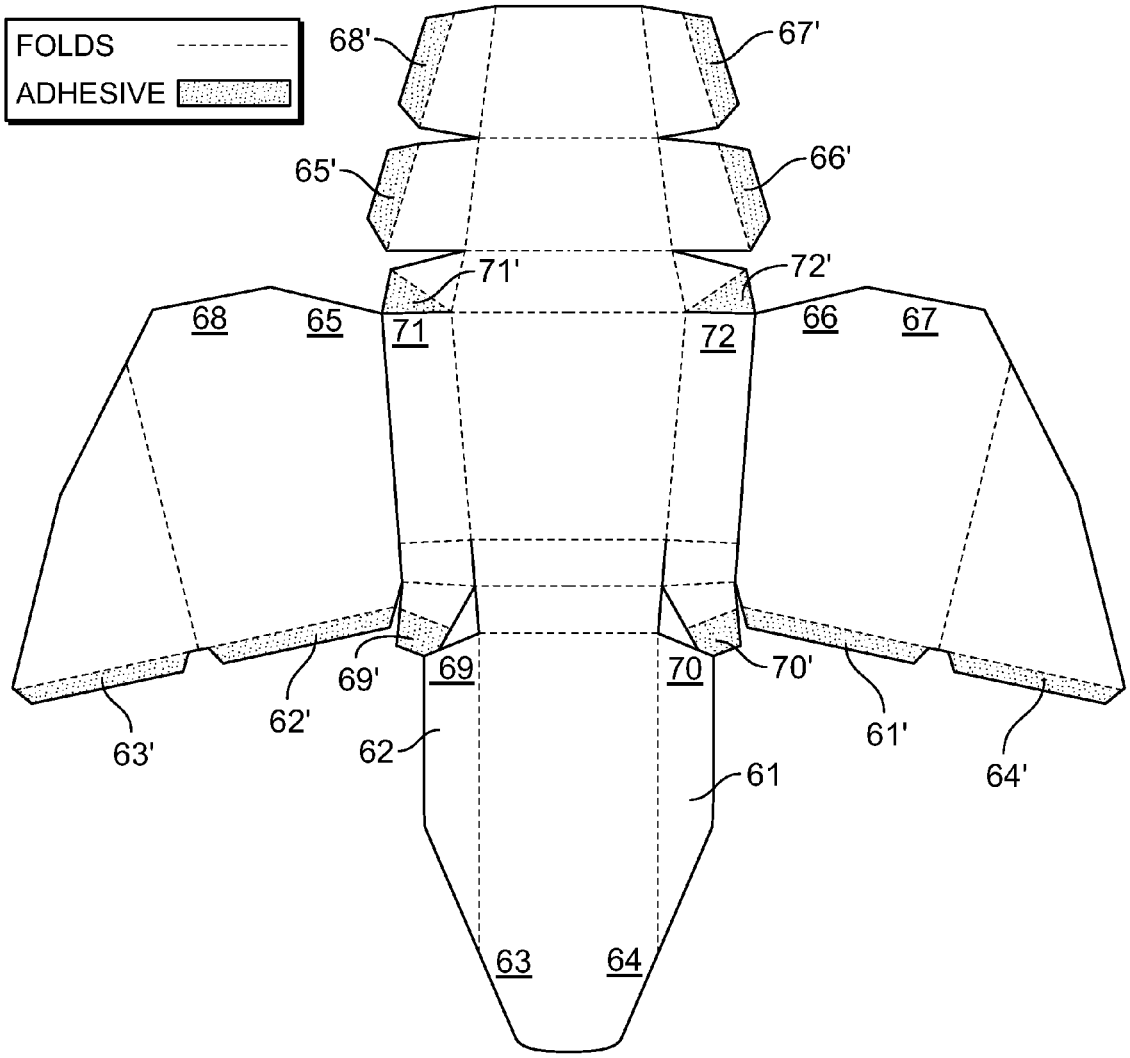
FIG. 6 is a top plan view of a blank mask of the present invention showing a sixth embodiment.

FIGS. 1 and 2 comprise numbered tabs which are matched to corresponding numbered slots or cuts in solid lines. FIGS. 3 and 4 comprise numbered tabs which are matched to corresponding numbered cuts as well as shaded adhesive sections. FIGS. 5 and 6 comprise numbered adhesive sections, shown in shading and numbered non-adhesive section, but do not comprise tabs or cuts. Adhesive sections may be covered with removable protective sheet during shipping, which is removed prior to assembly. Alternatively, adhesive sections may require moisture to activate prior to assembly. Alternatively, the numbered sections illustrated as non-adhesive may also be adhesive.

The embodiments vary by the type of connections and minor differences in the shapes of the panels. Other types of connections and panel shapes are contemplated so long as the blank has the overall butterfly shape and the connections are suitable to join panels together. The number of connections may vary if the panels have modified shapes, as discussed below and illustrated in FIG. 12. The minimum number of connections contemplated is six, namely, one connection on each side of the front panel 100 coupled to each of the side panels 200, 300; one connection on each side of the back panel 500 coupled to each of the side panels 200, 300 and one connection proximate the top panel 400 at each intersection of the front panel 100 and side panels 200, 300.

Figure 7:
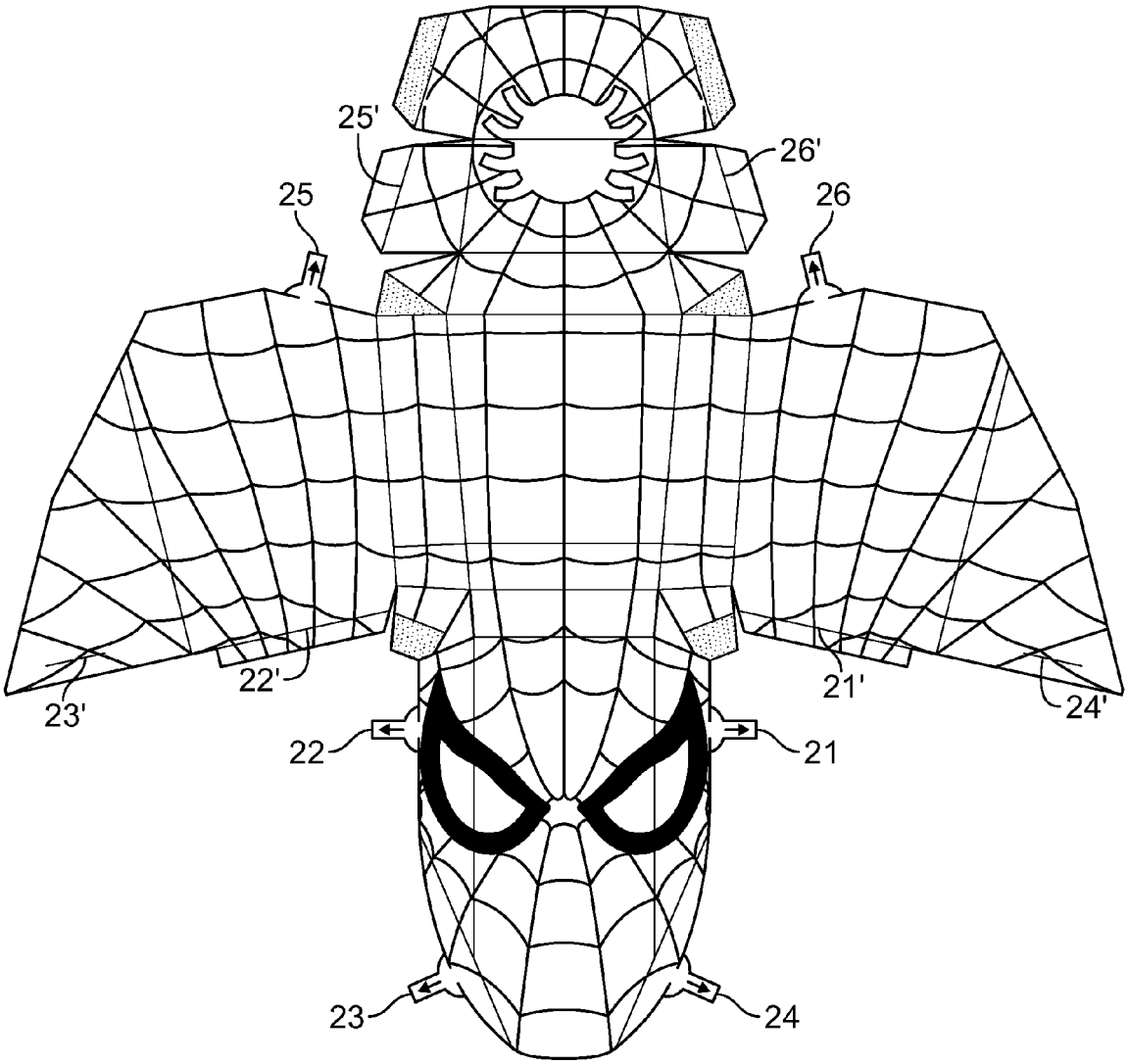
FIG. 7 is a top plan view of a blank mask of the present invention of the third embodiment and depicting an imprinted humanoid design of a known superhero character.
Figure 8:
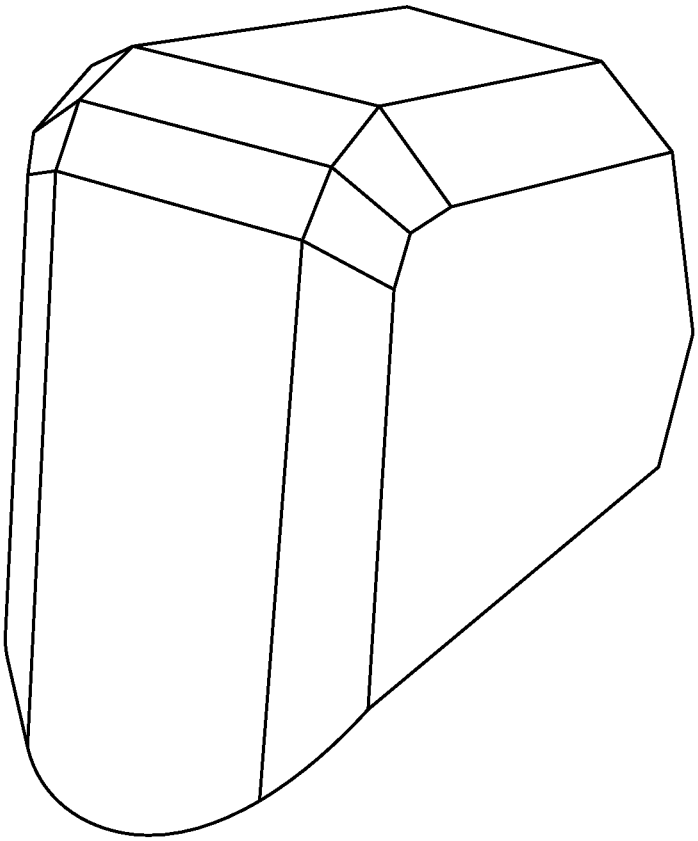
FIG. 8 is a perspective view of an assembled mask of the present invention made from the blank of FIG. 1.
Figure 9:
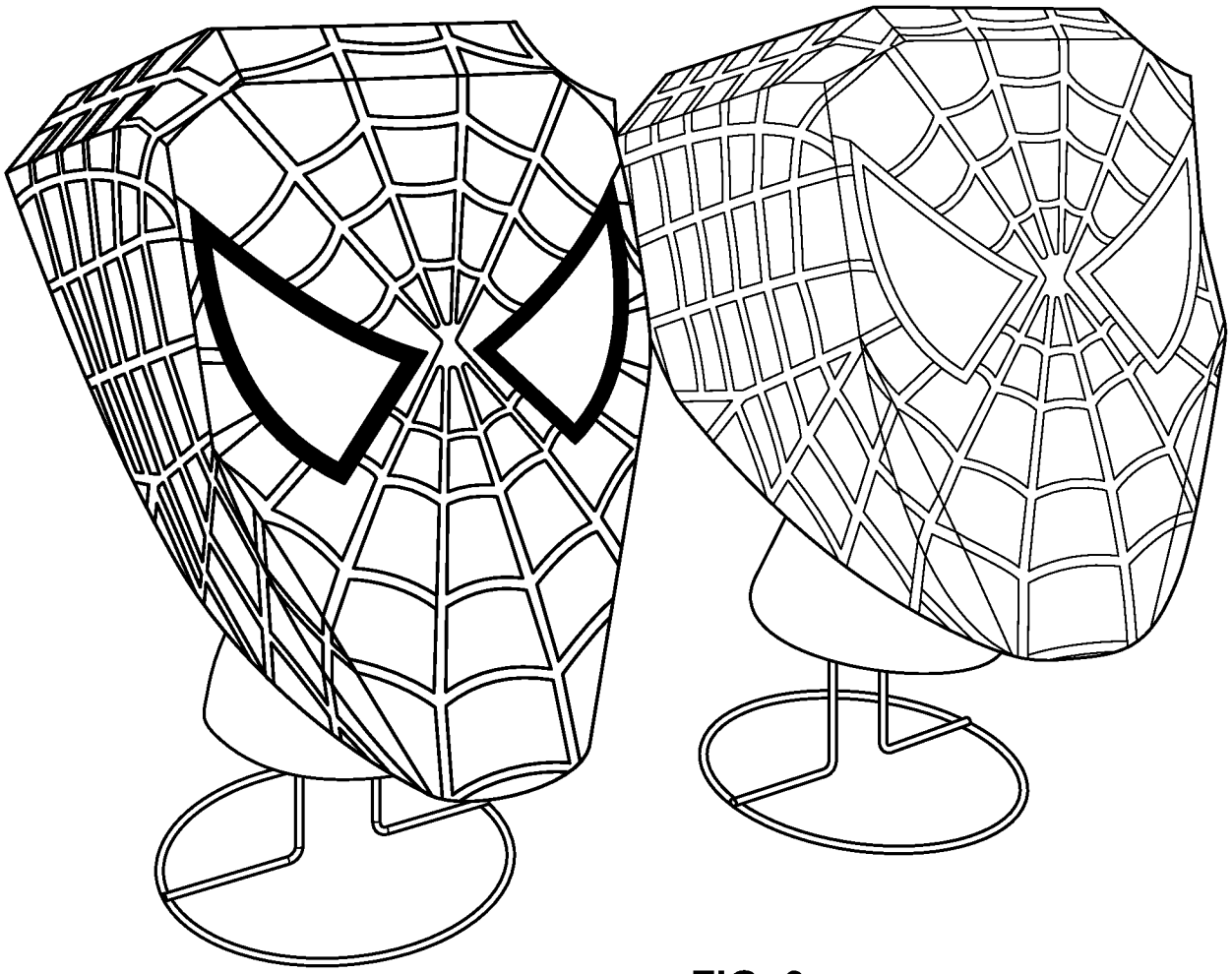
FIG. 9 is a perspective view of two assembled masks of the present invention made from any of the blanks of FIGS. 1-6, depicting the same imprinted humanoid design of a known superhero character in partially finished and finished states.

FIG. 7 illustrates the blank of FIG. 3 with a design of a known superhero face, namely Spider-Man™. This blank was suitable as it comprises a rounded chin design, as compared to the chin on the front panel of FIG. 2, for example, which is more square-shaped. The skilled worker having regard to the specification and drawings will choose appropriate blank embodiments of the present invention which are suitable to the desired design.

Figure 12:
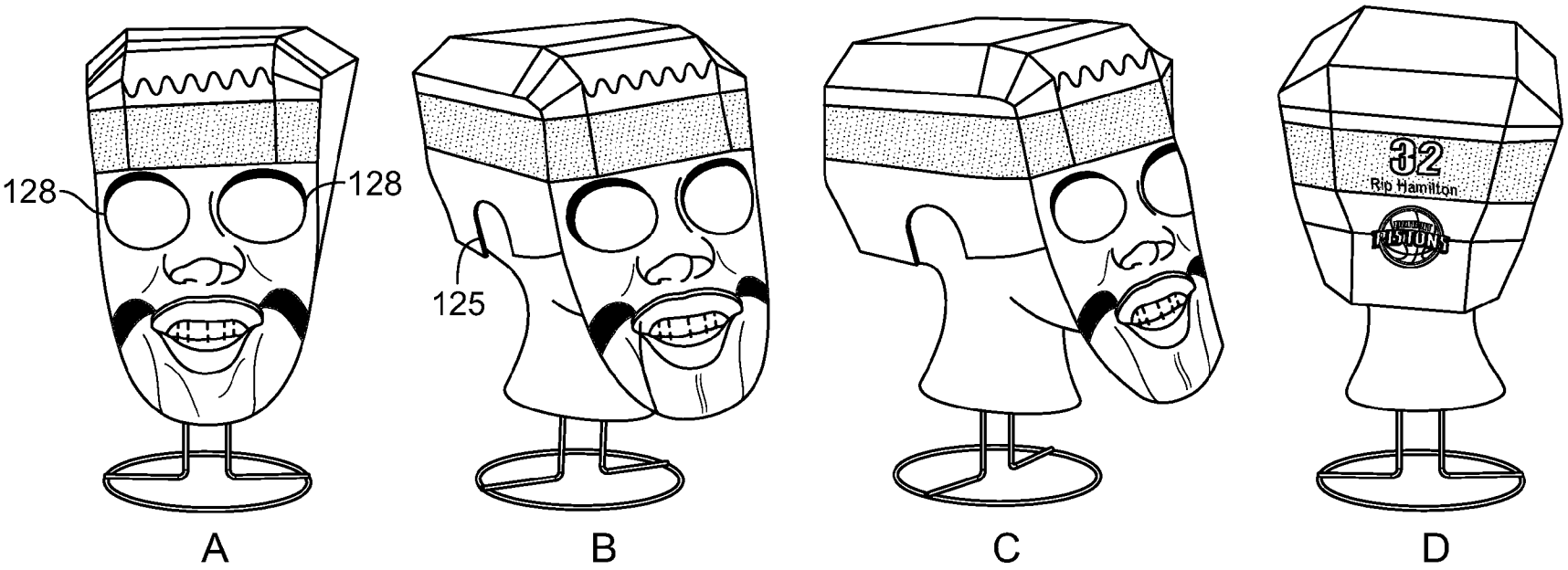
FIG. 12 depicts front (A), perspective (B and C) and back (D) views of an assembled mask made from a seventh embodiment of the present invention, depicting a known sports personality.

Other blank embodiments of the present invention may comprise shortened side panels 200, 300 with less connections, as shown in FIG. 12. As well, various shapes may be cut out from one or more panels such as semi-circles 125 to accommodate the user's ears in side panels 200, 300 or ovals 128 to accommodate the user's eyes in front panel 100, both shown in FIG. 12.

The blank may be made from paper, cardboard, plastic or any suitable material which can be folded stored and shipped in two-dimensions, for subsequent assembly. A combination of different materials may also be used, such as more rigid material for the majority of the blank and transparent material at various locations such as at the eye placement on the front panel. Holes or various shapes may be precut in one or more panel or perforated for the user to remove as needed. The fold lines may be pre-stamped to expedite assembly. Assembly may be done by anyone of school age or older, having regard to the following assembly instructions:

1. Fold the blank along all the fold lines.
2. a) Embodiments with tabs and cuts connections: Insert a numbered tab into and through the corresponding numbered cut. For example, tab 1 is inserted into cut 1', tab 2 is inserted into cut 2', etc.

2. b) Embodiments with adhesive section connections: Activate the numbered adhesive section by removing protective sheet or wetting, then apply to the corresponding non-adhesive numbered section.

Fold back the side panels to lock the connections in place.

3. Perforate eye holes, if applicable and as needed, for wear.

As such, the top panel 400 is integrally joined to all other panels. The front panel 100 is integrally joined to the top panel 400 and adapted to be coupled to the right side panel 200 by connections 1, 1' and 4, 4' and left side panel 300 by connections 2, 2' and 3, 3'. As well, the back panel 500 is integrally joined to the top panel 400 and adapted to be coupled to the right side panel 200 by connections 6, 6' and 7, 7' and left side panel 300 by connections 5, 5' and 8, 8'. Corner connections 9, 9' and 10, 10' once assembled provide a smooth and continuous look to the mask at the interface of panels 100, 300, 400 and 100, 200, 400 respectively.

In a similar manner, in FIG. 2, the front panel is integrally joined to the top panel and adapted to be coupled to the right side panel by connections 11, 11' and 14, 14' and left side panel by connections 12, 12' and 13, 13'. As well, the back panel is integrally joined to the top panel and adapted to be coupled to the right side panel by connections 16, 16' and 17, 17' and left side panel by connections 15, 15' and 18, 18'. Corner connections 19, 19' and 20, 20' once assembled provide a smooth and continuous look to the mask at the interface of the front, right and top panels, as well as the front, left and top panels respectively.

In a similar manner, in FIG. 3, the front panel is integrally joined to the top panel and adapted to be coupled to the right side panel by connections 21, 21' and 24, 24' and left side panel by connections 22, 22' and 23, 23'. As well, the back panel is integrally joined to the top panel and adapted to be coupled to the right side panel by connections 26, 26' and 27, 27' and left side panel by connections 25, 25' and 28, 28'. Corner connections 29, 29' and 30, 30' on the front and 31, 31' and 32, 32' at the rear, once assembled, provide a smooth and continuous look to the mask at the interface of the various panels. FIG. 7 illustrates a blank having a design on the embodiment of FIG. 3.

In a similar manner, in FIG. 4, the front panel is integrally joined to the top panel and adapted to be coupled to the right side panel by connections 41, 41' and 44, 44' and left side panel by connections 42, 42' and 43, 43'. As well, the back panel is integrally joined to the top panel and adapted to be coupled to the right side panel by connections 46, 46' and 47, 47' and left side panel by connections 45, 45' and 48, 48'. Corner connections 49, 49' and 50, 50' on the front and 51, 51' and 52, 52' at the rear, once assembled, provide a smooth and continuous look to the mask at the interface of various panels.

In a similar manner, in FIG. 5, the front panel is integrally joined to the top panel and adapted to be coupled to the right side panel by connections 151, 151' and 154, 154' and left side panel by connections 152, 152' and 153, 153'. As well, the back panel is integrally joined to the top panel and adapted to be coupled to the right side panel by connections 156, 156' and 157, 157' and left side panel by connections 155, 155' and 158, 158'. Corner connections 159, 159' and 160, 160' on the front and 161, 161' and 162, 162' at the rear, once assembled, provide a smooth and continuous look to the mask at the interface of various panels.

In a similar manner, in FIG. 6, the front panel is integrally joined to the top panel and adapted to be coupled to the right side panel by connections 61, 61' and 64, 64' and left side panel by connections 62, 62' and 63, 63'. As well, the back panel is integrally joined to the top panel and adapted to be coupled to the right side panel by connections 66, 66' and 67, 67' and left side panel by connections 65, 65' and 68, 68'. Corner connections 69, 69' and 70, 70' on the front and 71, 71' and 72, 72' at the rear, once assembled, provide a smooth and continuous look to the mask at the interface of various panels.

Figure 10:
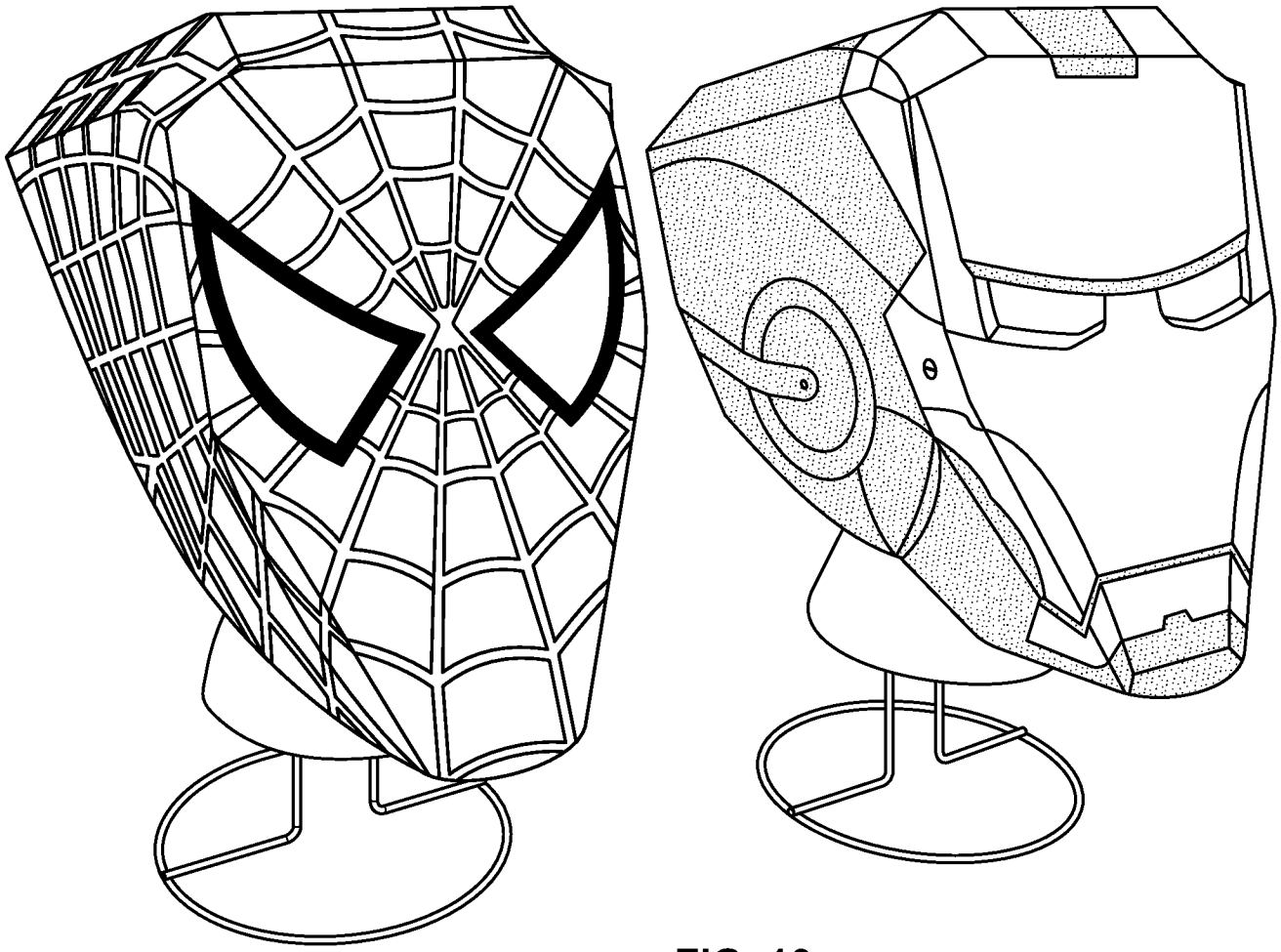
FIG. 10 is a perspective view of two assembled masks of the present invention made from any of the blanks of FIGS. 1-6, depicting different printed humanoid designs of known superhero characters in finished states.
Figure 11:
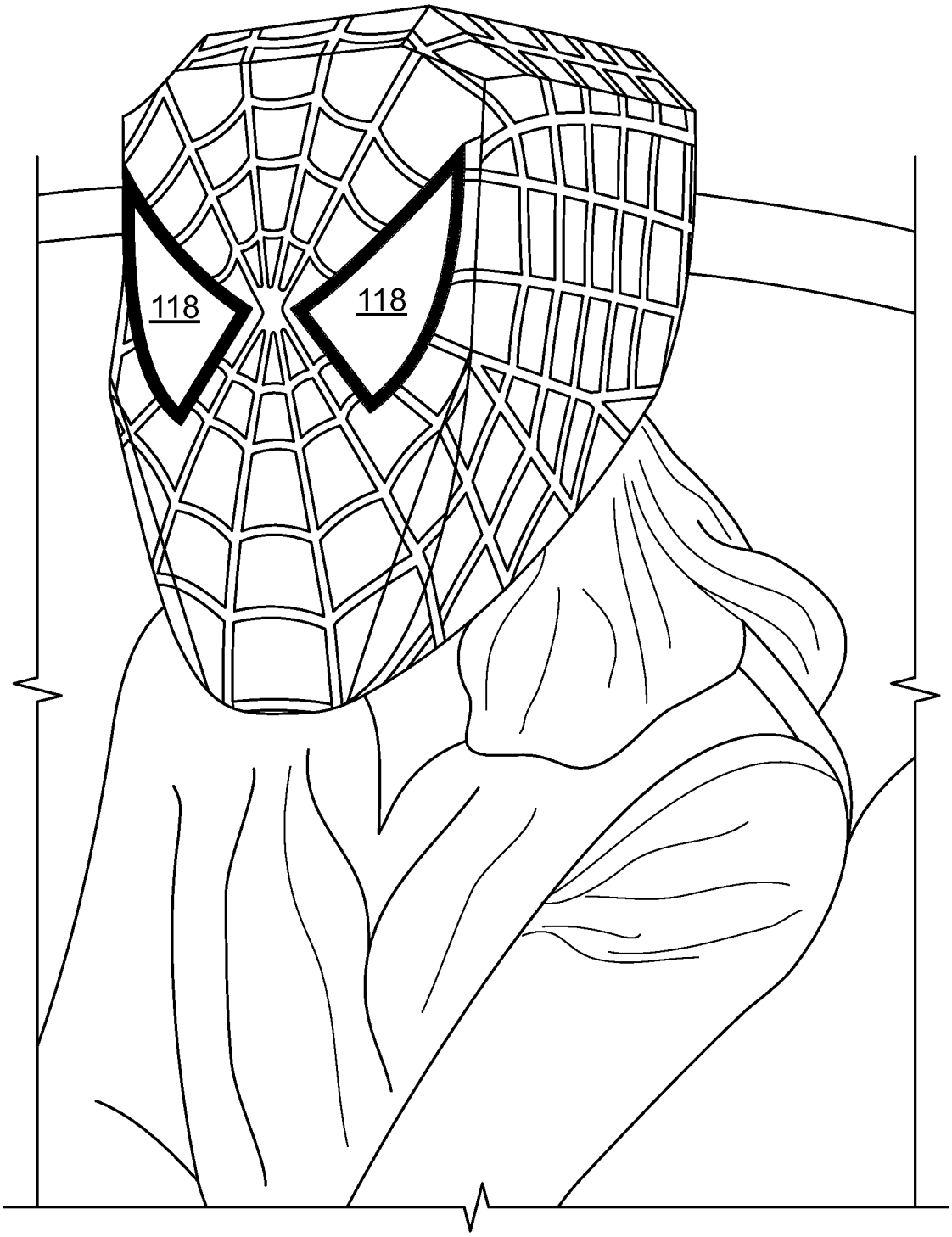
FIG. 11 is a perspective view of one of the assembled masks of the present invention of FIGS. 9 and 10, worn by a user.

Assembled embodiments of the present invention are depicted in FIGS. 8-12. FIGS. 10 and 12 show examples of superhero and sports figure designs. Other designs are contemplated. FIG. 11 shows a user wearing one of the assembled blanks of FIGS. 9 and 10. The eye location 118, 128 on front panel 100 may optionally be cut out or made of transparent or porous material to enhance the user's wearing experience.

The blank of the present invention may be precut from a template or formed within a larger surface for easy removal by a user.

While it is contemplated that the blanks of the present invention are of suitable size to be worn by a user, any size blank may be constructed with regard to the present description and figures, including smaller model versions. In addition, while the blanks may be constructed with colour designs, the skilled worker will appreciate that any type of design may be applied to the blank including design outlines that may be coloured or painted by a user prior to assembly of the mask.

Although the description above contains many specific details, these should not be construed as limiting the scope of the embodiments but as merely providing illustrations of some of the presently preferred embodiments. Thus the scope of the embodiments should be determined by the appended claims and their legal equivalents, rather than by the examples given.

I claim:

1. A single blank for forming a three-dimensional mask, comprising:

a top panel integrally joined to a left side panel, a right side panel, a front panel comprising a plurality of first fold lines and a back panel comprising a plurality of second fold lines;

each of said left and right side panels coupled to said front panel with one or more first connections, said front panel along the plurality of first fold lines; and each of said left and right side panels coupled to said back panel with one or more second connections, said back panel configured to be folded along the plurality of second fold lines.

2. The blank of claim 1, adapted for positioning on the head of a user.

3. The blank of claim 1, wherein one or more connections consists of a tab and corresponding slot.

4. The blank of claim 1, wherein one or more connections comprises an adhesive section coupled to a non-adhesive section or a first adhesive section coupled to a second adhesive section.

5. The blank of claim 1, further comprising one or more perforations on one or more panels.

6. The blank of claim 1, comprising two or more materials, each having a different rigidity, transparency or porosity.

7. The blank of claim 1, comprising material selected from the group consisting of paper, cardboard and plastic.

8. The blank of claim 1, further comprising one or more portions configured to be perforated.

9. The blank of claim 1, formed within a larger surface, wherein the blank is configured to be easily removed from the larger surface.

10. The blank of claim 1 further comprising a design on one surface.

11. The blank of claim 1, wherein said fold lines comprise one or more crease.

12. A single blank for forming a three-dimensional mask, comprising:

a top panel integrally joined to a left side panel at a first joining line said left side panel comprising a first fold line, said left side panel configured to be folded at the first fold line, a right side panel at a second joining line said right panel comprising a second fold line, said right side panel configured to be folded at the second fold line, a front panel at a third joining line said front panel comprising a plurality of third fold lines, said front panel configured to be folded at the plurality of third fold lines, and a back panel at a fourth joining line said back panel comprising a plurality of fourth fold lines, said back panel configured to be folded at the plurality of fourth fold lines;

said left side panel configured to be coupled to said front panel with one or more first connections and configured to be coupled to said back panel with one or more second connections;

said right side panel configured to be coupled to said front panel with one or more third connections and configured to be coupled to said back panel with one or more fourth connections.

13. The blank of claim 12, wherein said one or more first, second, third and fourth connections are selected from the group consisting of a tab and a corresponding slot, an adhesive section and a corresponding non-adhesive section, and a first adhesive section and a corresponding second adhesive section.

14. A single blank for forming a three-dimensional mask, comprising:

a top panel integrally joined to a left side panel, a right side panel, a front panel and a back panel;

said left side, right side, front and back panels configured to be folded about the top panel, each fold being in the same direction relative the top panel;

each of said folded left and right side panels configured to be coupled to said folded front panel with one or more connections; and each of said folded left and right side panels configured to be coupled to said folded back panel with one or more connections.

15. The blank of claim 14, wherein said one or more connections are selected from the group consisting of a tab and a corresponding slot, an adhesive section and a corresponding non-adhesive section, and a first adhesive section and a corresponding second adhesive section.

* * * * *

UNITED STATES PATENT AND TRADEMARK OFFICE

CERTIFICATE OF CORRECTION

PATENT NO. : 9,032,554 B2
APPLICATION NO. : 13/688201
DATED : May 19, 2015
INVENTOR(S) : Cary M. Lucier It is certified that error appears in the above-identified patent and that said Letters Patent is hereby corrected as shown below:

In the Claims

Column 4, Line 42, in claim 1
"along the plurality of first fold lines; and" should read
-- configured to be folded along the plurality of first fold lines; and --

Column 5, Line 6, in claim 12
"a left side panel at a first joining line said left side panel" should read
-- a left side panel at a first joining line, said left side panel --

Column 5, Line 9, in claim 12
"a right side panel at a second joining line said right side panel" should read
-- a right side panel at a second joining line, said right side panel --

Column 5, Line 12, in claim 12
"a front panel at a third joining line said front panel" should read
-- a front panel at a third joining line, said front panel --

Signed and Sealed this
Fifteenth Day of September, 2015

Michelle K. Lee

Michelle K. Lee
*Director of the United States Patent and Trademark Office*